252-99 AU 165 EX
2/8/77 XR 4,007,124

United States Patent [19]
Collier et al.
[11] 4,007,124
[45] Feb. 8, 1977

[54] PROCESS FOR PREPARING A SILICATE-PYROPHOSPHATE DETERGENT COMPOSITION

[75] Inventors: Everett Joshua Collier; John Edward Morrow, both of Cincinnati, Ohio

[73] Assignee: The Procter & Gamble Company, Cincinnati, Ohio

[22] Filed: June 30, 1975

[21] Appl. No.: 592,010

Related U.S. Application Data

[63] Continuation-in-part of Ser. No. 550,063, Feb. 14, 1975, abandoned.

[52] U.S. Cl. ..... 252/109; 252/99; 252/110; 252/113; 252/116; 252/131; 252/135; 252/136; 252/140; 252/531; 252/532; 252/538; 252/539

[51] Int. Cl.² ..... C11D 3/08; C11D 3/14; C11D 11/02; C11D 11/04

[58] Field of Search ..... 252/99, 109, 131, 135, 252/136, 531, 532, 538, 539, 140, 110, 113, 116; 159/4 R, 4 CC

[56] References Cited

UNITED STATES PATENTS

| | | | |
|---|---|---|---|
| 2,941,947 | 6/1960 | Schauer | 252/135 |
| 2,992,186 | 7/1961 | Hellsten | 252/135 |
| 3,112,176 | 11/1963 | Haden | 423/329 |
| 3,629,951 | 12/1971 | Davis | 159/4CC |
| 3,743,610 | 7/1973 | Weldes | 252/527 |

FOREIGN PATENTS OR APPLICATIONS

| | | | |
|---|---|---|---|
| 2,433,485 | 2/1975 | Germany | 252/131 |

*Primary Examiner*—Dennis L. Albrecht
*Attorney, Agent, or Firm*—William H. Gould; Thomas H. O'Flaherty; Richard C. Witte

[57] ABSTRACT

An acidified detergent composition is prepared by acidifying aqueous alkali metal silicate to form a premix; mixing that premix with an aqueous slurry containing surfactant and at least one structurant, i.e. structure-forming compound; drying; and optionally adding admixed adjuvant. Alkali metal pyrophosphate must be included in the composition, either as structurant or admixed adjuvant or both.

19 Claims, No Drawings

PROCESS FOR PREPARING A SILICATE-PYROPHOSPHATE DETERGENT COMPOSITION

CROSS-REFERENCE

This application is a continuation-in-part of copending U.S. application Ser. No. 550,063 filed Feb. 14, 1975, now abandoned.

BACKGROUND OF THE INVENTION

For many years the primary material used to control water hardness in detergent products has been sodium triphosphate at levels of approximately 50% by weight of the finished detergent product. Within the past few years the use of high levels of sodium triphosphate has come under scrutiny because of the suspicion that soluble phosphate species accelerate the eutrophication or aging process of water bodies. This eutrophication is ordinarily evidenced by the rapid growth of algae in the water body.

Those skilled in the detergency arts have for many years equated the alkali metal pyrophosphates such as sodium pyrophosphate $Na_4P_2O_7$ with the alkali metal triphosphates such as sodium triphosphate $Na_5P_3O_{10}$ from the standpoint of builder effectiveness. It is known that pyrophosphates and triphosphates when used as builders will each sequester one mol of calcium or magnesium water hardness per mol of the phosphate species. Pyrophosphate detergency builders however, unlike triphosphates, will under certain conditions form minor amounts of dicalcium pyrophosphate, a completely neutralized insoluble salt. The precipitation of the pyrophosphates discussed above takes place on the fabrics being cleansed or upon the surfaces of the washing machine. Such buildup of the calcium pyrophosphate sale is undesirable in that the precipitates have a tendency to remain on the fabrics through several wash cycles and continue to buildup, thus causing harsh fabric. Similarly, the calcium pyrophosphate will after several cycles in a washing machine cause unsightly deposition or scale on the exposed surfaces. This precipitation phenomenon of the pyrophosphates has led many detergent manufacturers to avoid pyrophosphates and to instead use triphosphates.

It was suggested in U.S. Pat. No. 2,381,960 to Johnson, issued Aug. 14, 1945, that the effectiveness of sodium pyrophosphate in reducing water hardness could be obtained by adding the pyrophosphate to the solution of hard water after an alkaline material had been first added to the water. The alkaline materials taught by Johnson were sodium orthophosphate, sodium and potassium hydroxide, sodium and potassium carbonates and sesquicarbonates, soap, and sodium silicate having an $SiO_2$:$Na_2O$ weight ratio greater than 1.5. The point of addition of the tetrasodium pyrophosphate to the solution is stated to be prior to the formation of a macroscopic precipitate of the hardness ions and the aforementioned alkaline materials.

In U.S. Pat. No. 2,326,950 issued Aug. 17, 1943 to Kepfer, it is taught that tetrasodium pyrophosphate is used more efficiently to control water hardness when it is used in conjunction with an alkaline material which added to the solution before a macroscopic precipitate of the hardness ions and the pyrophosphate is formed. The alkaline materials taught by Kepfer are sodium borate, sodium metasilicate ($SiO_2$:$Na_2O$:1:1) and disodium hydrogen orthophosphate. The processes of controlling water hardness by somehow increasing the effectiveness of sodium pyrophosphate taught by Kepfer and Johnson, herein incorporated by reference, suffer from the defect that the composition could not be effectively prepared without going to the trouble of positively insuring the delay of the pyrophosphate relative to the alkaline materials or vice versa. Thus the inventions of Kepfer and Johnson could only with great difficulty be adapted for use in granular or liquid products which are favored by the consumer today.

It can be seen, however, that pyrophosphate has the potential of being a much more effective detergency builder than the triphosphate salts. In the first instance it has a molecular weight advantage which allows more mols of the pyrophosphate salt to be present in a composition at a given weight fraction of elemental phosphorus than does triphosphate.

More importantly, the pyrophosphate tetravalent anion has a high association constant with the first calcium ion with which it associates. This first association product is the monocalcium pyrophosphate divalent anion. The divalent anion has a very small association constant with the second calcium ion to form the dicalcium pyrophosphate salt which is electrically neutral. In the absence of any material which makes the dicalcium pyrophosphate more stable, one of the associated calcium ions will be free to disassociate and to seek a more stable association such as with body soil on the fabrics or with anionic detergent. The main purpose of controlling calcium ions, whether free or associated in a weak complex, is to prevent the lastmentioned reaction with the detergent or soiled fabric from occurring. As the pyrophosphate anion strongly holds one mol of calcium ion per pyrophosphate anion it has been common practice to attempt the first association (sequestration) on a mol for mol basis. If, however, the pyrophosphate anion can be induced to strongly associate (precipitate) with two mols of calcium ion the pyrophosphate level used could be reduced substantially.

British Pat. No. 943,405, invented by Store et al, assigned to the Co-Operative Wholesale Society, Limited, and published Dec. 4, 1963 discloses a soap composition containing sodium metasilicate pretreated with fatty acid. The alkalinity of the metasilicate having a molar $Na_2O/SiO_2$ ratio of 1/1 is treated with 88–90% of the stoichiometric amount of fatty acid based on the alkalinity of the silicate, and the resultant material is incorporated into soap powder which contained no synthetic surfactant and no inorganic builder.

U.S. Pat. No. 3,708,428 issued Jan. 2, 1973, to McDonald discusses the reacting of anionic surfactant-forming acids such as fatty acid and alkyl benzene sulfonic acid with sodium silicates having an $Na_2O/SiO_2$ weight ratio of from about 2:1 to about 1:4 to form an in situ colloidal "silica" sol having an $Na_2O$:$SiO_2$ weight ratio of from about 1:4 to about 1:2000 or greater. The reactants are said to be used in approximately stoichiometric proportions.

Detergent compositions containing this colloidal silica are said to have enhanced cleaning ability. However it was "important" to McDonald that the inclusion of water soluble alkali builders, illustrated by sodium or potassium orthophosphates, or complex phosphates (i.e. triphosphates, pyrophosphates, and glassy phosphates), alkali carbonates, borates, silicates, or neutral salts, such as sodium chloride or sodium sulfate, or magnesium sulfate, be restricted to levels of concentration of the order of 4% by weight or lower. McDonald goes on to state that the desired advantages of the in situ formed colloidal silicas on the removal of soils will be found to be appreciably impaired if the foregoing limits are not strictly adhered to.

Soluble silicates are often added to detergent or additive products to protect exposed machine surfaces from corrosion. It has been found, however, that soluble silicates interfere with the precipitation of calcium hardness as dicalcium pyrophosphate. Surfactants commonly used in detergent products have also been found to interfere with dicalcium pyrophosphate precipitation.

It has now been found that the pretreatment of silicate with acid prior to its incorporation into the detergent product diminishes the tendency of soluble silicates and surfactants to interfere with the precipitation of calcium by pyrophosphate. This effect was not only unrecognized by McDonald; it is contrary to the clear import of McDonald.

The use of alkali metal pyrophosphate in conjunction with the acidified silicate of the present invention in a detergent composition substantially decreases the amount of calcium ion in the wash solution. While not wishing to be bound by theory, it is believed that acidified silicate encourages the precipitation of calcium ions in the wash solution as insoluble dicalcium pyrophosphate. Thus, while in prior art compositions pyrophosphate salts were only able to effectively sequester on a 1:1 mol basis with calcium hardness, the present invention allows the pyrophosphate to effectively control twice the amount of calcium which is possible by sequestration. The precipitation of the dicalcium pyrophosphate takes place with the aid of the acidified silicate such that the precipitated salt does not form an unsightly scum on the exposed surfaces of the washing machine or deposit on fabrics to cause a harsh feel.

Objects of the present invention are to more efficiently utilize alkali metal pyrophosphates as detergent builders; to provide a reduced phosphorus content detergent product without substantially impairing cleaning in hard water; to utilize an alkali metal pyrophosphate salt in such a manner that it precipitates as the dicalcium salt thereof rather than sequesters calcium; to provide greater cleaning due to increased hardness control in a product of limited phosphate content; and to diminish the deposition of water hardness salts upon fabrics in the wash solution.

These and other objects of the invention which will become apparent can be achieved by preparing a detergent composition comprising alkali metal pyrophosphate, acidified silicate and surfactant.

SUMMARY OF THE INVENTION

A detergent composition is prepared by the process of a. acidifying an aqueous alkali metal silicate with acid, during agitation, thereby forming a silicate premix, wherein the alkali metal silicate has the formula $\rho$ $M_2O.SiO_2$, where M is alkali metal and $\rho$, the ratio of (mols $M_2O$) to (mols $SiO_2$), is from about 0.25 to about 0.50, and wherein the amount of acid, expressed as a ratio of (equivalents of acid) to (mols $SiO_2$ in the silicate), is between about 0.0005 and about 0.4;

b. mixing said silicate premix with an aqueous slurry comprised of surfactant, water, and at least one structurant, i.e. structure-forming compound, thereby forming a crutcher mix, wherein the surfactant is anionic, nonionic, semipolar, zwitterionic, ampholytic, or mixtures thereof;

c. drying said crutcher mix to a moisture of from about 0.5% to about 15% by weight of the dried crutcher mix; and d. adding admixed adjuvant to said dried crutcher mix, thereby forming said detergent composition;

wherein included as either structurant or admixed adjuvant or both is alkali metal pyrophosphate, $M_xH_yP_2O_7$, where M is alkali metal and x and y are integers having the sum of 4; and wherein percentages of the components by weight, expressed in relation to the final detergent composition, are: $SiO_2$ in the silicate from about 1.5% to about 16%; surfactant from about 4% to about 50%; structurant from about 4% to about 90%; alkali metal pyrophosphate from about 5% to about 60%; and admixed adjuvant from 0 to about 80%.

DETAILED DESCRIPTION OF THE INVENTION

I. COMPONENTS

Pyrophosphate is an essential component of the present invention. Pyrophosphate salts useful herein have alkali metal cations, such as sodium or potassium, preferably sodium. They can be obtained commercially or can be formed by neutralization of the corresponding phosphoric acid or acid salt.

Readily available commercially are tetrasodium pyrophosphate $Na_4P_2O_7$ and its decahydrate $Na_4P_2O_7.10H_2O$, tetrapotassium pyrophosphate $K_4P_2O_7$, sodium acid pyrophosphate or "acid pyro" $Na_2H_2P_2O_7$ and its hexahydrate $Na_2H_2P_2O_7.6H_2O$, and pyrophosphoric acid $H_4P_2O_7$. Monosodium pyrophosphate and trisodium pyrophosphate also exist, the latter as the anhydrous form or the mono- or nona-hydrate. The generic formula for the anhydrous forms of these compounds can be expressed as $M_xH_yP_2P_7$, where M is alkali metal and x and y are integers having the sum of 4.

Pyrophosphate in the form of alkali metal salts can be added to the crutcher, can be admixed into the dried crutcher mix, or in minor quantity as discussed infra can be added to the silicate premix. Alternatively, pyrophosphates in acid form can be added to the crutcher, or in minor quantity as discussed infra can be added to the silicate premix, in which events the alkali metal salt is formed in situ upon reaction with alkaline components.

Pyrophosphates are not good builders in the acid form and thus the finished product must contain alkali metal pyrophosphates in an amount from about 5% to about 60% preferably about 10% to about 50%, and most preferably from 15% to 40% by weight of the finished detergent compositions. If acid pyrophosphates are employed, an alkaline ingredient should also be included in the composition. Where not all of the alkali metal pyrophosphate is included in the slurry, additional amounts up to the total desired in the finished product can be admixed with the dried product of the slurry. In fact, the advantages of the present invention are also obtained when all of the pyrophosphate is so admixed.

Preferably the pyrophosphate is substantially free of orthophosphate. Orthophosphate salts should be held to no more than about 2% by weight of the composition because in the laundry they tend to form coarse precipitates agglomerated with soil which attach to the clothes, causing a harsh feel and poor whiteness maintenance.

It is well known that triphosphates revert, upon drying, to mixtures of pyrophosphate and orthophosphate; hence it is not desirable to use large quantities of triphosphate, especially when drying is carried out to relatively low moistures as described infra. Also, appreciable amounts of triphosphate, though they do not specifically interfere, do not allow the advantages of the present invention to be secured. For this reason, the weight of triphosphate should be restricted to no more than 40% of the weight of the pyrophosphate, and preferably no more than 20% of the weight of the pyrophosphate.

Pyrophosphate salts under the conditions expressed in the present invention do not substantially revert into the orthophosphate salts upon drying. The pyrophosphates of the present invention may be either anhydrous or hydrated forms, preferably the former in a finely divided form to permit rapid dissolution in the wash.

Silicate Premix

Another essential component of the present invention is silicate having the formula $\rho\ M_2O.SiO_2$. M is alkali metal, preferably sodium or potassium, most preferably sodium. The mol ratio of $M_2O$ to $SiO_2$ is expressed by $\rho$. [The Greek symbol rho is used to clearly distinguish it from weight ratios commonly found in the literature, which are often expressed in inverse form, i.e. as $SiO_2$:$M_2O$.] The silicate ratio $\rho$ of this invention should be between about 0.25 and about 0.50, preferably between about 0.26 and 0.42, and most preferably between 0.27 and 0.33.

The silicate is used in liquid, concentrated, aqueous form, and is available in this form from a number of commercial sources, as is well known in the art.

Liquid silicate is used in an amount which provides amounts of $SiO_2$ by weight of the finished detergent composition between about 1.5% and about 16%, preferably between about 2% and 13%, and most preferably between 2.5% and 10%.

Section II infra, entitled "PROCESS", describes acidification of the silicate as an essential step of the invention. Acidification can be carried out by any acid; organic or inorganic, and is usually a source of hydronium ions in aqueous medium. The acid should be in liquid form for rapid mixing and can be dissolved, emulsified or suspended in water. The disclosure of specific operable acids which follows is representative and is not intended to be limiting.

The acid can be the acid form of a compound which acts as surfactant in the desired detergent composition. This is convenient because it is readily available, and is desirable also because after reaction with silicate it becomes, not a diluent, but a useful component of the composition. Examples of such preferred surfactant-acids are alkyl benzene sulfonic acid, alkyl sulfuric acid, and alkyl ether sulfuric acid. Fatty acid can be used, and is a preferred surfactant-acid when soap is desired in the final detergent composition either as surfactant or suds suppressor or for any other purpose; specific soaps useful for these purposes are described infra.

The acid can also be the acid form of pyrophosphate, for example $M_2H_2P_2O_7$, and more specifically can be $Na_2H_2P_2O_7$. This is a preferred acid because it promotes intimate association of the silicate and pyrophosphate components of the present invention.

Alternatively, mineral acids such as sulfuric or hydrochloric acid can be used if desired and convenient. Having lower equivalent weights than many organic acids, smaller physical quantities need to be used to add any given number of acid equivalents.

The amount of acid used in the instant invention, expressed as a ratio of (equivalents of acid) to (mols of $SiO_2$ in the silicate), is between about 0.0005 and about 0.4. Preferably this ratio is between about 0.001 and about 0.1, and most preferably it is between 0.002 and 0.02. Both (mols of $Na_2O$) and (equivalents of acid), two critical elements of the present invention, are thus defined in terms relative to (mols of $SiO_2$).

The amounts of acid given above are lower than stoichiometric; indeed in the lower portions of the operable range they are minute. They are believed to cause a transient polymerization of — Si — O — chains in the silicate, which tends to form colloidally insoluble silicates. When acidification is carried out with surfactant-acids, the hydrophobic moiety is believed to associate with the silicate, increasing the effects of polymerization. As discussed infra, agitation time is an element in the successful utilization of this invention: too long a time permits the silicate to revert to an equilibrium condition generally equivalent to using a lower $Na_2O$/-$SiO_2$ ratio silicate, which is not within the scope of this invention, while too short a time may result in lumping of the premix, especially if agitation is deficient at the point of acid addition to the silicate.

Crutcher Mix

The surfactant of the present invention can be anionic, nonionic, semi-polar, ampholytic, or zwitterionic in nature, or can be mixtures thereof. It is present in the aqueous slurry at levels of from about 4% to about 50%, preferably from about 8% to about 40%; and most preferably between about 12% and about 30% by weight of the detergent composition.

Preferred anionic surfactants of the present invention are water-soluble salts of: an alkyl benzene sulfonate with an average alkyl chain length between 11 and 13, preferably 11.8 carbon atoms; an ethoxylated sulfated alcohol with an average degree of ethoxylation of about 1 to 8 and an alkyl chain length of about 8 to 16; tallow ethoxy sulfate; tallow alcohol sulfates; a $C_6$-$C_{20}$ $\alpha$-sulfocarboxylic acid or ester thereof having 1 to 14 carbon atoms in the alcohol radical; a $C_8$–$C_{24}$ paraffin sulfonate; a $C_{10}$–$C_{24}$ $\alpha$-olefin sulfonate or mixtures thereof; or other anionic sulfur-containing surfactant.

A preferred alkyl ether sulfate surfactant component of the present invention is a mixture of alkyl ether sulfates, said mixture having an average (arithmetic mean) carbon chain length within the range of about 12 to 16 carbon atoms, preferably from about 14 to 15 carbon atoms, and an average (arithmetic mean) degree of ethoxylation of from about 1 to 4 mols of ethylene oxide.

Specifically, such preferred mixtures comprise from about 0 to 10% by weight of mixture of $C_{12\text{-}13}$ compounds, from about 50 to 100% by weight of mixture of $C_{14\text{-}15}$ compounds, and from about 0 to 45% by weight of mixture of $C_{16\text{-}17}$ compounds, and from about 0 to 10% by weight of a mixture of $C_{18\text{-}19}$ compounds. Further, such preferred alkyl ether sulfate mixtures comprise from about 0 to 30% by weight of mixture of compounds having a degree of ethoxylation of 0, from about 45 to 95% by weight of mixture of compounds having a degree of ethoxylation from 1 to 4, from about 5 to 25% by weight of mixture of compounds having a degree of ethoxylation from 5 to 8, and from about 0 to 15% by weight of mixture of compounds having a degree of ethoxylation greater than 8. The sulfated condensation products of ethoxylated alcohols of 8 to 24 alkyl carbons and with from 1 to 30, preferably 1 to 4 mols of ethylene oxide may be used in place of the preferred alkyl ether sulfates discussed above.

Another class of surfactants which may be used in the present invention includes the water-soluble salts, particularly the alkali metal, ammonium, and alkylolammonium salts of organic sulfuric reaction products having in their molecular structure an alkyl group containing from about 8 to about 22 carbon atoms and a sulfuric acid ester group. Examples of this group of surfactants are the sodium and potassium alkyl sulfates, especially those obtained by sulfating the higher alcohols ($C_8$-$C_{18}$ carbon atoms) produced by reducing the glycerides of tallow or coconut oil.

Preferred water-soluble organic surfactants herein include alkyl benzene sulfonates [preferably essentially linear (LAS) although branched chain (ABS) may be used] containing from about 9 to 15 carbon atoms in the alkyl group. Examples of the above are sodium and potassium alkyl benzene sulfonates in which the alkyl group contains from about 11 to about 13 carbon atoms, in straight chain or branched chain configuration, e.g., those of the type described in U.S. Pat. Nos. 2,220,099 and 2,477,383. Especially valuable are straight chain alkyl benzene sulfonates in which the average of the alkyl groups is about 11.2 carbon atoms, abbreviated as $C_{11.2}$LAS.

Other classes of useful surfactants herein include the water-soluble salts of $\alpha$-sulfonated fatty acids containing from about 6 to about 20 carbon atoms, and their esters made from alcohols containing from about 1 to about 14 carbon atoms.

Olefin sulfonate surfactants utilizable herein comprise olefin sulfonates containing from about 10 to about 24 carbon atoms. Such materials can be produced by sulfonation of $\alpha$-olefins by means of uncomplexed sulfur trioxide followed by neutralization under conditions such that any sultones present are hydrolyzed to the corresponding hydroxyalkane sulfonates. The $\alpha$-olefin starting materials preferably have from 14 to 16 carbon atoms. Said preferred $\alpha$-olefin sulfonates are described in U.S. Pat. No. 3,332,880, incorporated herein by reference.

Paraffin sulfonates embraced in the present invention are essentially linear and contain from 8 to 24 carbon atoms, preferably 12 to 20 and more preferably 14 to 18 carbon atoms in the alkyl radical.

Other anionic surfactants utilizable herein include sodium alkyl glyceryl ether sulfates, especially those ethers of higher alcohols having 10 to 18 carbon atoms, and more especially those derived from tallow and coconut oil; sodium coconut oil fatty acid monoglyceride sulfonates and sulfates; sodium or potassium salts of alkyl phenol ethylene oxide ether sulfate containing about 1 to about 10 units of ethylene oxide per molecule, wherein the alkyl groups contain about 8 to about 12 carbon atoms; water-soluble salts of 2-acyloxyalkane-1-sulfonic acids containing from about 2 to 9 carbon atoms in the acyl group and from about 9 to about 23 carbon atoms in the alkane moiety; and $\beta$-alkyloxy alkane sulfonates containing from about 1 to 3 carbon atoms in the alkyl group and from about 8 to 20 carbon atoms in the alkane moiety.

Water-soluble salts of the higher fatty acids, i.e. soaps, are useful as the surfactant of the present invention. This class of compounds includes ordinary alkali metal soaps such as the sodium, potassium, ammonium and alkylolammonium salts of higher fatty acids containing from about 8 to about 24 carbon atoms and preferably from about 12 to about 22 carbon atoms. Soaps can be made by direct saponification of fats and oils or by the neutralization of free fatty acids. Particularly useful are the sodium and potassium salts of the mixtures of fatty acids derived from coconut oil, tallow, fish oil, and whale oil, e.g. sodium and potassium tallow soap.

A particularly useful anionic surfactant mixture comprises from about 2% to about 20% by weight of an alkyl benzene sulfonate having from 9 to 15 carbon atoms in the alkyl radical and mixtures thereof, the cation being an alkali metal preferably sodium; and from about 2% to about 15% by weight of an alkyl ethoxy sulfate having from 10 to 20 carbon atoms in the alkyl radical and from 1 to 30 ethoxy groups and mixtures thereof, having an alkali metal cation, preferably sodium.

Water-soluble nonionic surfactants are also useful in the instant composition. Such nonionic surfactants can be broadly defined as compounds produced by the condensation of alkylene oxide groups (hydrophilic in nature) with an organic hydrophobic compound, which may be aliphatic or alkyl aromatic. The length of the polyoxyalkylene group which is condensed with any particular hydrophobic group can be readily adjusted to yield a water-soluble compound having the desired degree of balance between hydrophilic and hydrophobic elements.

For example, a well-known class of nonionic surfactants is made available on the market under the trade name "Pluronic" sold by Wyandotte Chemicals. These compounds are formed by condensing ethylene oxide with a hydrophobic base formed by the condensation of propylene oxide with propylene glycol. Other suitable nonionic surfactants include the polyethylene oxide condensates of alkyl phenols, e.g. the condensation products of alkyl phenols with ethylene oxide, said alkyl phenols having an alkyl group containing from about 6 to 12 carbon atoms in either a straight chain or branched chain configuration, and said ethylene oxide being present in amounts equal to 5 to 25 mols of ethylene oxide per mol of alkyl phenol.

Also utilizable herein are water-soluble condensation products with ethylene oxide of aliphatic alcohols having from 8 to 22 carbon atoms, in either straight chain or branched configuration; e.g. a coconut alcohol-ethylene oxide condensate having from 5 to 30 mols of ethylene oxide per mol of coconut alcohol, the coconut alcohol fraction having from 10 to 14 carbon atoms. Other useful nonionics are the condensation product of tallow fatty alcohol with about 11 mols of ethylene oxide and the condensation product of a $C_{13}$ (avg.) secondary alcohol with 9 mols of ethylene oxide.

Semi-polar surfactants include water-soluble amine oxides containing one alkyl moiety of from about 10 to 28 carbon atoms and 2 moieties selected from the group consisting of alkyl groups and hydroxyalkyl groups containing from 1 to about 3 carbon atoms, and especially alkyl dimethyl amine oxides wherein the alkyl group contains from about 11 to 16 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Ampholytic surfactants include derivatives of aliphatic secondary and tertiary amines in which the aliphatic moiety can be straight chain or branched and wherein one of the aliphatic substituents contains from about 8 to 18 carbon atoms and one contains an anionic water-solubilizing group, e.g. carboxy, sulfonate, sulfate, phosphate, or phosphonate.

Zwitterionic surfactants include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water-solubilizing group, especially alkyldimethyl-ammonio-propane-sulfonates and alkyl-dimethylammonio-hydroxy-propane-sulfonates wherein the alkyl group in both types contains from about 14 to 18 carbon atoms.

A typical listing of the classes and species of surfactants useful herein appear in U.S. Pat. No. 3,852,211, issued to Ohren Dec. 3, 1974, incorporated herein by reference. The foregoing disclosure of surfactant compounds and mixtures which can be used in the instant compositions is representative of such materials, but is not intended to be limiting.

The lower limit on the amount of water in the aqueous slurry to be dried is determined by the amount which is sufficient to allow the acidified silicate, surfactant, and structurant to become thoroughly mixed prior to the drying step, and to be fluid enough to handle; e.g. in spraydrying to be fluid enough to be pumped and atomized. The upper limit of water in the slurry is effectively determined by the economics of not having to drive off any more water than is necessary to achieve the dried product of the requisite moisture content. Generally, the amount of water in the aqueous slurry should be from about 20% to about 60%, preferably from about 25% to about 55%, and most preferably from about 30% to about 50% by weight of the total composition of the slurry.

A structure-forming compound is herein defined as a structurant. Such a component is required to promote drying and to impart desired physical properties to the dried product and to the finished detergent composition. Although this statement applies to all methods of drying and the products resulting therefrom, it is especially important when the drying process is spray-drying, as otherwise the resultant granules tend to be sticky and not flow freely in either the manufacturing equipment or the packing machinery or the carton in the consumers' hands.

The structurant can have, but need not have additional functions in the detergent composition. It can be a detergency builder, such as sodium pyrophosphate or nitrilotriacetate or the aluminosilicates described infra. It can be sodium carbonate which provides alkalinity to the composition, neutralizes salts such as acid pyrophosphate present in the slurry or admixed in the dried product, and to a certain extent controls hardness by precipitating calcium and magnesium ions, all of which tend to improve detergency. Or the structurant may be otherwise inert, like sodium sulfate, and exercise none of these secondary functions.

Structurants are ordinarily inorganic compounds. However this is not a requirement, as illustrated by the abovementioned nitrilotriacetate. Suitable structurants do not, of course, include those inorganic compounds which interfere with the functioning of the invention as discussed supra. Among phosphates, orthophosphate is therefore not a suitable structurant but, within the limits hereinbefore specified, triphosphate and glassy phosphates are structurants.

Suitable structurants for the instant invention are calcium carbonate; natural and synthetic clays such as montmorillonite, hectorite, saponite, volchonskoite, nontronite and sauconite; nitrilotriacetates, sodium aluminosilicates; and alkali metal pyrophosphates, triphosphates, glassy phosphates, carbonates, bicarbonates, sesquicarbonates, chlorides, borates, perborates, sulfates, bisulfates, aluminates, and mixtures thereof.

The amount of structurant in the slurry, expressed as weight per cent on the basis of the final detergent composition, is between about 4% and 90% preferably between about 40% and 85%, and most preferably between 60% and 80%.

Admixed Adjuvants

As described in detail infra, the crutcher mix containing acidified silicate, surfactant, water and structurant is dried. Following this step can be added, if desired, admixed adjuvants in finely-divided, particulate form to make the final detergent composition of the invention. Admixed adjuvants which can be added in major proportions are diluents and builders, the latter both inorganic and organic. These components can be added exclusively as admixed adjuvants or, if they qualify as structurants under the definition given supra, they can be added in part to the crutcher mix as structurant and in remaining part to the dried crutcher mix as an admixed adjuvant. Alternatively, of course, such structurant materials can be added entirely to the crutcher as described supra.

Certain zeolites or aluminosilicates, when dried with the components of the slurry, enhance the function of the silicate of the slurry and add building capacity in that the aluminosilicates associate with calcium hardness. When admixed with the dried product of the slurry the aluminosilicates function as a cobuilder to the pyrophosphates. One such aluminosilicate which is useful in the compositions of the invention is an amorphous water-insoluble hydrated compound of the formula $Na_x(xAlO_2.ySiO_2)$, wherein $x$ is a number from 1 to 1.2 and $y$ is 1, said amorphous compound being further characterized by a $Mg^{++}$ exchange capacity of from about 50 mg. eq. $CaCO_3$/g. 50 milligrams equivalent of $CaCO_3$ hardness/gram to about 150 mg. eq. $CaCO_3$/g. (150 milligrams equivalent of $CaCO_3$ hardness/gram) anhydrous basis. Inasmuch as calcium carbonate has a molecular weight of approximately 100, a valance of 2, and hence an equivalent weight of approximately 50, the $Mg^{++}$ exchange capacity can alternatively be expressed as from about 1 to about 3 milliequivalents per gram, i.e. from about 100 to about 300 milliequivalents per 100 grams, anhydrous basis. This ion exchange builder is more fully described in the patent application of Gedge et al Ser. No. 1505-74 filed on July 16, 1974 and laid open to the public on Jan. 16, 1975 by the Republic of Eire and herein incorporated by reference; corresponding applications were also filed in West Germany on July 12, 1974 as Ser. No. P24-33485 and in Great Britain on July 15, 1974 as Ser. No. 31238-74.

A second water-insoluble synthetic aluminosilicate ion exchange material useful herein has the formula $Na_z[(AlO_2)_z.(SiO_2)_y]xH_2O$ wherein $z$ and $y$ are integers of at least 6; the molar ratio of $z$ to $y$ is in the range from 1.0 to about 0.5, and $x$ is an integer from about 15 to about 264; said aluminosilicate ion exchange material having a particle size diameter from about 0.1 micron to about 100 microns; a calcium ion exchange capacity on an anhydrous basis of at least about 200 mg. eq./g (200 milligrams equivalent of $CaCO_3$ hardness/gram); and a calcium ion exchange rate on an anhydrous basis of at least about 2 grains/gallon/-minute/gram. In alternative units, the foregoing calcium ion exchange capacity can be expressed as at least about 4 milliequivalents per gram, i.e. at least about 400 milliequivalents per 100 grams, on an anhydrous basis. This crystalline ion exchange builder is more fully described in Belgian Pat. No. 814,874 issued on Nov. 12, 1974 to Corkill et al, herein incorporated by reference.

The above described aluminosilicates are employed at levels of from about 1% to about 40%, preferably about 5% to about 25% by weight based on the total detergent composition.

Inorganic admixed adjuvants include calcium carbonate; sodium aluminosilicates; and alkali metal pyrophosphates, carbonates, borates, bicarbonates and sulfates. Specific examples of such compounds are sodium pyrophosphate, sodium carbonate, calcium carbonate, sodium bicarbonate, sodium borate and sodium perborate.

Examples of suitable organic detergency builder salts are: (1) water-soluble aminopolycarboxylates, e.g. sodium and potassium ethylenediaminetetraacetates, nitrilotriacetates and N-(2-hydroxyethyl)-nitrilodiacetates; (2) water-soluble salts of phytic acid, e.g. sodium and potassium phytates — see U.S. Pat. No. 2,739,942; (3) water-soluble polyphosphonates, including specifically the sodium, potassium and lithium salts of ethane-1-hydroxy-1,1-diphosphonic acid, methylene diphosphonic acid, ethylene diphosphonic acid, ethane-1,1,2-triphosphonic acid, ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; and (4) water-soluble salts of polycarboxylate polymers and copolymers as described in U.S. Pat. No. 3,308,067 issued to Diehl on Mar. 7, 1967.

A useful detergent builder which may be employed in the present invention comprises a water-soluble salt of a polymeric aliphatic polycarboxylic acid having the following structural relationships as to the position of the carboxylate groups and possessing the following prescribed physical characteristics: (a) a minimum molecular weight of about 350 calculated as to the acid form; (b) an equivalent weight of about 50 to about 80 calculated as to acid form; (c) at least 45 mol percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of the above-described builders include polymers of itaconic acid, aconitic acid, maleic acid, mesaconic acid, fumaric acid, methylene malonic acid and citraconic acid and copolymers with themselves.

Other organic builders which can be used satisfactorily include water-soluble salts of mellitic acid, citric acid, pyromellitic acid, benzene pentacarboxylic acid, oxydiacetic acid, carboxymethyloxysuccinic acid, and oxydisuccinic acid.

Admixed adjuvants are unnecessary when all the components of the instant invention are added to the crutcher mix and dried. If not, they can be added at levels up to 80% by weight of the final detergent composition, preferably up to 50%, and most preferably up to 20%. These limits can alternatively be expressed as 0–80%, 0–50%, and 0–20%, respectively, by weight of the detergent composition.

The detergent compositions of this invention preferably contain the water-soluble surfactant in a ratio to the total builders present of from about 10:1 to about 1:10 by weight, preferably from about 3:1 to about 1:3. This is so regardless of whether the builders are added as structurant or as admixed adjuvant or partly as both.

The compositions of the present invention can also contain minor ingredients, as well known in the detergent arts. These can be added either to the crutcher mix slurry or admixed following the drying step. Soil suspending agents at about 0.1% to 10% by weight such as water-soluble salts of carboxymethylcellulose and carboxyhydroxymethylcellulose, and polyethylene glycols having a molecular weight of about 400 to 10,000, are common components of the detergent compositions of the present invention. Dyes, pigments, optical brighteners, and perfumes can be added in varying amounts as desired.

Other materials such as germicides, enzymes, anticaking agents such as sodium sulfosuccinate and sodium toluene sulfonate, and sodium benzoate may also be added.

Suds control agents are common additives to detergent compositions. These may be suds boosters, such as amine oxides, e.g. coconut dimethylamine oxide; and amides, e.g. dimethyl amide and diethanol amides having 10 to 14 carbon atoms in the alkyl chains. Alternatively, if desired, they may be suds suppressors such as the higher fatty acids taught in U.S. Pat. No. 2,954,347 issued on Sept. 27, 1960 to St. John et al; high melting microcrystalline waxes as taught in copending United States patent application USSN 539,756, invented by Tate et al, filed Jan. 9, 1975; and silicone/silica mixtures as taught in British Pat. No. 1,304,803 issued on May 30, 1973 to Bartalotta et al.

Additional components which are desirable in the present invention are the whiteness maintenance additives. In particular glassy phosphates at levels of from about 0.1% to 4% having the formula $$(M_2O)_x(P_2O_5)_y$$

wherein M is an alkali metal, preferably sodium; $y$ having a value of from about 5 to 50, preferably 7 to 25 with the ratio of $y$:$x$ from about 1:1 to about 1:1.5 are useful in the present invention for whiteness maintenance.

Preferred values of $y$ above are such that there are 10, 14, and 21, most preferably 14 and 21 phosphorous atoms in the compound. A more preferred range of glassy phosphate is from about 0.5% to about 2.5% by weight, most preferably from about 1.0% to about 2% by weight of the finished product. Alternatively the formula of the glassy phosphates can be expressed as $M_{2y+2}P_y O_{6y+1}$ wherein M is an alkali metal and $y$ varies from 7 to 12.

II. PROCESS

An essential part of this invention is the preparation of a silicate premix, which is accomplished by acidifying an aqueous alkali metal silicate with acid, during agitation.

The silicate is heated, preferably to between 120° and 180° F., and acid is added slowly during agitation. The type and degree of agitation are not critical, and it can be provided by any convenient means, such as turbine, propeller, or screw.

Following the addition of acid, the silicate premix is preferably subjected to a period of agitation. It is believed that the effects of acid are to a degree reversible, and such an agitation period reduces localized excesses of acid and minimizes localized lumping and insolubility. However too long an agitation period tends to promote equilibration which tends to undo the effects of the acid treatment. The length of the agitation period is not critical and can be several hours in length, although it is preferably from about 1 to about 120 minutes and most preferably from 5 to 30 minutes.

The order in which the silicate premix and the remaining components of the crutcher mix are mixed together is not critical, and may be done in any convenient manner. For example, all components other than the silicate premix can be crutched together in the normal way, and the silicate premix can be added last. Or, the silicate premix can be added to the crutcher during the preparation of the crutcher mix; i.e. while other components are being added. Alternatively, the silicate premix can be added to the crutcher first, and the other components added and crutched in thereafter.

Crutching time, after silicate premix addition, should be kept to a reasonable length of time but is not so important as the silicate premix agitation period. The usual crutching times of 0–30 minutes, familiar to the skilled detergent artisan, are good, and times up to about 2 hours are satisfactory if the crutcher mix remains hot.

The chemical mechanism of silicate pretreatment with acid is not fully understood and it is not wished to be bound by theory; however it is believed that acid removes ionic sodium from the silicate molecules. If this is carried out to its extreme, as in the preparation of silica gel, the sodium can be nearly completely removed and the resultant silica will be nearly completely insoluble in water. If this happens to a great extent on even a localized basis in the process of the instant invention, undesirable insoluble lumps are formed in the crutcher mix; this lumping is of course related to the degree of agitation that is provided, with greater shear and overall mix recirculation permitting more acid addition without significant undesirable effects. The effect of agitation on instantaneous mixing is well-known to those skilled in the art.

It is well-known that, within limits, detergency tends to improve as pH is increased. Hence it may be desired to maintain the pH of the finished detergent composition relatively unchanged, even though significant amounts of acid have been added in the course of preparing the silicate premix. This pH change can be overcome by adding caustic to the crutcher mix, preferably just before drying so it has little time to effect reversion of the silicate in the manner described above.

The crutcher mix, prepared as described supra, is dried to a moisture content of from about 0.5% to about 15% by weight of the dried crutcher mix. It is preferred to dry to moistures between about 1% and about 10% by weight of the dried crutcher mix and most preferably to between 2% and 5%. In interpreting these moistures, it should be kept in mind that pyrophosphate does not tie up large quantities of water upon drying as does the crystalline hexahydrate of sodium triphosphate.

The lower practical limit of moisture is determined by the economics of drying and the avoidance of chemical decomposition.

The maximum practical limit of moisture for the instant invention is that which results in undesirable physical properties for handling and storage. Compositions having up to 15% moisture show the benefits of this invention. However, reduced levels of moisture show even greater benefits. Hence it is preferred to dry to below 10% moisture, and below 5% is especially preferred.

The preferred method of drying the compositions of the present invention is spray-drying, especially as described in U.S. Pat. Nos. 3,629,651 and 3,629,955 issued to Robert P. Davis et al on Dec. 28, 1971, both of which are hereby incorporated by reference. Other methods of drying include drum drying, freeze drying, oven drying, and the agglomeration method described in U.S. Pat. No. 2,895,916 issued to Milenkevich et al on July 21, 1959.

A preferred product form for the dried detergent compositions of this invention is as detergent granules prepared by spray-drying. The spray-drying process can be carried out in countercurrent or cocurrent drying towers, preferably in countercurrent towers. In its simplest aspect the products of the present invention are spray dried by pumping the slurry which has been crutched to the spray-drying tower where the slurry is fed through a series of atomizing nozzles in a direction opposite to the flow of the hot drying gases. The temperature of the hot air mixture should be in the range of from about 150° to about 1500° F., preferably from about 200° to about 1000° F., and most preferably from about 220° to about 700° F.

The temperatures range within which the granules of the present invention reach is from about 120° F. to about 300° F., preferably from about 140° F. to about 275° F., and most preferably from about 150° F. to about 250° F.

When a multilevel spray-drying apparatus is employed such as described in the Davis et al patent, previously incorporated herein by reference, the product is suitably spray dried with the remaining conditions listed therein.

Admixing adjuvants to the dried crutcher mix can be accomplished, when desired, by a dry-blending process in a manner familiar to anyone skilled in the art. Although the moisture of the final detergent composition is affected by adding adjuvant, it is still the moisture of the dried crutcher mix before adding adjuvant that is primarily important to this invention.

Another product form in which the dried detergent compositions of the present invention can be used is as a laundry bar. Disclosures of detergent laundry bars can be found in U.S. Pat. No. 3,178,370 issued Apr. 13, 1965 and British Pat. No. 1,064,414 issued Apr. 5, 1967, both to Okenfuss and both hereby incorporated by reference.

III. EXAMPLES

EXAMPLE 1

A silicate premix was prepared by adding 20.6 grams of unhardened tallow fatty acid having a molecular weight of about 275 to 10,882 grams of liquid silicate having a molar ratio of $Na_2O$ to $SiO_2$ of 0.31 and containing 40% solids: 3315 grams $SiO_2$ and 1037 grams $Na_2O$.

The silicate was heated to 150° F. and the acid was added during a 3 to 4 minute period, using a propeller to provide agitation. After all the acid was added, the silicate premix was subjected to an agitation period of 5 minutes.

The premix was then added to a previously prepared partial crutcher mix containing sodium alkyl benzene sulfonate, sodium toluene sulfonate, sodium sulfate, additional unsaturated tallow fatty acid, and free NaOH in stoichiometric proportion to all the fatty acid. Tetrasodium pyrophosphate and optical brightener were added after the treated silicate.

Crutcher mix having a moisture of about 46% and a temperature of about 190° F. was spray-dried in a pilot scale tower to form granules having a moisture content of 4.5%. Spray-drying commenced immediately after the crutcher was complete, and was finished in about 30 minutes.

The composition of the final detergent composition is given in detail on Table I.

This composition of Example 1 was tested in side-by-side comparisons with 4 other compositions that are not within the scope of this invention; these are designated as Reference compositions R1 through R3 respectively, and their compositions are also given in detail on Table I.

Reference compositions R1 through R4 were made on the same pilot scale equipment as the composition of Example 1. There was of course no silicate premix. Otherwise, crutching and spray-drying conditions were comparable. Composition R4 was a commercial product.

One performance evaluation applied to this group of compositions as a clay soil removal test. Clay is well known to be sensitive to the effects of free multivalent ions, such as unsequestered and unprecipitated $Ca^{++}$ and $Mg^{++}$.

Illite subsoil clay obtained in southwest Ohio was applied to Dacron fabric by padding, followed by oven drying. Swatches cut from the soiled fabric were read, before and after washing, by a Gardner XL-10 Color Difference Meter with the ultraviolet screened out. Differences in whiteness were determined by the Diehl equation $$\Delta W_D = \Delta\,[100 - \sqrt{(100-L)^2 + 5.29\,(a^2+b^2)}]$$

The soiled swatches were washed in a Tergitometer operating at 80 cycles per minute for 10 minutes at a temperature of 70° F., using a water-to-cloth ratio of 30:1 and a usage of 0.13% detergent composition by weight. Hardness was controlled by a synthetic solution having a 3:1 ratio of $Ca^{++}$:$Mg^{++}$. PEG 6000 in the form of an aqueous solution was added in an amount equivalent to 0.9% PEG on a detergent composition basis. Following washing, the swatches were rinsed, using the same type water used for washing, and were dried before making the final Gardner measurement.

Results of these tests are shown in Table II. In that table are included abbreviated references to composition.

Table I

| EXAMPLE NO. | 1 | R1 | R2 | R3 | R4 |
|---|---|---|---|---|---|
| COMPOSITION, etc. | | | | | |
| Silicate Premix | | | | | |
| $\rho$=mols $Na_2O$/mols $SiO_2$ | 0.31 | 0.31 | 0.42 | 0.42 | 0.42 |
| Silicate Solids (wt. %) | 10.0 | 10.0 | 10.0 | 10.0 | 10.0 |
| $SiO_2$ (wt. %) | 7.6 | 7.6 | 7.1 | 7.1 | 7.1 |
| Acid Type | fatty | none | none | none | none |
| Eq. Acid/Mols $SiO_2$ | 0.0014 | — | — | — | — |
| Agitation Period (min.) | 5 | — | — | — | — |
| Crutcher Mix | | | | | |
| Surfactant (wt. %) | 18 LAS<br>2 soap | 18 LAS<br>2 soap | 18 LAS<br>2 soap | 18 LAS<br>2 soap | 18 LAS<br>2 soap |
| Structurant (wt. %) | 18.3 pyro<br>bal. $Na_2SO_4$ | 18.3 pyro<br>bal. $Na_2SO_4$ | 17 STP<br>bal. $Na_2SO_4$ | 25 STP<br>bal. $Na_2SO_4$ | 35 STP<br>bal. $Na_2SO_4$ |
| Na Toluene Sulfonate (wt. %) | 0.9 | 0.9 | 0.9 | 0.9 | 1.7 |
| Water (wt. %, slurry basis) | ~50 | ~50 | ~50 | ~50 | 47 |
| Admixed Adjuvant (wt. %) | none | none | none | none | none |
| Minor Ingredients (wt. %) | 0.6 bright.<br>[0.9 PEG] | 0.6 bright.<br>[0.9 PEG] | 0.6 bright.<br>[0.9 PEG] | 0.6 bright<br>[0.9 PEG] | 0.6 bright.<br>perf. |
| Moisture (wt. %; dried C.M. basis) | 4.5 | 5 | 8 | 8 | 11 |

Footnotes to Table I are given on Table X.

Table II

| | Clay Removal Performance ($\Delta W_D$) | | | |
|---|---|---|---|---|
| | Hardness (gr./gal.)<br>Composition | 4.5 | 7.0 | 9.0 |
| Example 1: | 18% pyrophosphate; acidified silicate | 22.4 | 18.5 | 16.8 |
| R1: | 18% pyrophosphate; no silicate pretreatment | — | 16.3 | 14.4 |
| R2: | 17% triphosphate | 20.8 | 16.1 | 14.8 |
| R3: | 25% triphosphate | 21.7 | 16.9 | 15.3 |
| R4: | 35% triphosphate; no polyethylene glycol | 22.2 | 20.7 | 16.7 |

A ($\Delta W_D$) of about 1 unit is statistically significant at the 90% confidence level.

It is apparent that in this test the performance of pyrophosphate and triphosphate are about equal when similarly formulated (17–18%) and processed (no special treatment). However the composition of the instant invention is distinctly better; superior even to a 25% triphosphate formula and approaching that of the 35% triphosphate commercial product which did not, however, contain polyethylene glycol.

The composition of Example 1, with three appropriate reference compositions, was also tested by a facial swatch test. Wash solutions of 7 gr./gal hardness (3/1 $Ca^{++}/Mg^{++}$), a temperature of 70° F., and 0.13 wt.% detergent composition were prepared for a Tergitometer. Swatches made from 65/35 polyester/cotton shirting material about 5" square were soiled by rubbing over the facial area, marked and cut in half. Each half was washed in one of the detergent solutions described above in a round robin design that provides for all pairs of products to be compared an equal number of times. Unsoiled terry swatches were added to the wash solution to make up a water to cloth ratio of about 30/1 by weight. The swatches and terry load fabrics were washed for 10 minutes at 80 cpm agitation, rinsed, dried and graded. Panel grading was done by rematching the half-swatches; visually examining them; and assigning a number grade ranging from 0 for a soiled unwashed swatch to 10 for a completely unsoiled swatch.

In Table III are given the overall scores obtained in this facial swatch test. The composition of the present invention cleaned significantly better than either the corresponding composition made without silicate acidification or a similar formula containing triphosphate instead of pyrophosphate; it cleaned as well as the high-triphosphate composition.

Table III

| Facial Swatch Cleaning | | |
|---|---|---|
| | Composition | Panel Score Units |
| Example 1: | 18% pyrophosphate, acidified silicate | 8 |
| R1: | 18% pyrophosphate, no silicate pretreatment | 5 |
| R2: | 17% triphosphate | 4 |
| R3: | 25% triphosphate | 8 |

EXAMPLE 2

Another detergent composition was prepared in a manner similar to that of Example 1 with the following exceptions:

15 grams of fatty acid and 7500 grams of liquid silicate were used (same types as in Example 1).

The agitation period following acid addition was 10 minutes.

The partial crutcher mix into which the silicate premix was added contained 10% of the sodium pyrophosphate, i.e. 2.3% on a finished detergent composition basis.

No free NaOH was added to the crutcher.

Carboxymethylcellulose was added to the crutcher after the silicate premix.

The percentages of the components were somewhat different, as shown on Table IV.

The moisture after drying was 4%.

EXAMPLE 3

A detergent composition was prepared in a manner similar to that of Example 2 with the following exceptions:

50 grams of tetrasodium pyrophosphate was added rapidly to the silicate premix, after addition of the fatty acid over a 3–4 minute period.

Moisture of the finished detergent composition was 0.5%.

EXAMPLE 4

A detergent composition was prepared in a manner similar to that of Example 3, except that the moisture of the finished detergent composition was approximately 5%. Its cleaning performance is similarly good to that of the composition of Example 3.

The compositions of Examples 3 and 4 given on Table IV were tested in side-by-side comparisons with reference compositions R4 and R5 as shown in Table IV, using procedures identical to those followed for Example 1 except for differences in fabric and water hardness. Clay soil removal performance for these compositions is shown on Table V.

Table IV

| EXAMPLE NO. | 2 | 3 | R5 | 4 | 5 |
|---|---|---|---|---|---|
| COMPOSITION, etc. | | | | | |
| Silicate Premix | | | | | |
| $\rho$=mols $Na_2O$/mols $SiO_2$ | 0.31 | 0.31 | 0.31 | 0.31 | 0.31 |
| Silicate Solids (wt. %) | 10.0 | 10.0 | 10.0 | 10.0 | 10.0 |
| $SiO_2$ (wt. %) | 7.6 | 7.6 | 7.6 | 7.6 | 7.6 |
| Acid Type | fatty | fatty* | none | fatty* | fatty* |
| Eq. Acid/Mols $SiO_2$ | 0.0014 | 0.0014 | — | 0.0014 | 0.0027 |
| Agitation Period (min.) | 10 | 5–10 | — | 5–10 | 5–10 |
| Crutcher Mix | | | | | |
| Surfactant (wt. %) | 18 LAS | 18 LAS | 18 LAS | 18 LAS | 18 LAS |
| | 3 soap | 3 soap | 3 soap | 3 soap | 3 soap |
| Structurant (wt. %) | 23 pyro | 23 pyro | 23 pyro | 23 pyro | 23 pyro |
| | bal. $Na_2SO_4$ | bal. $Na_2SO_4$ | bal. $Na_2SO_4$ | bal. $Na_2SO_4$ | bal. $Na_2SO_4$ |
| Na Toluene Sulfonate (wt. %) | | | | | |
| Water (wt. %, slurry basis) | | | | | |
| Admixed Adjuvant (wt. %) | none | none | none | none | none |
| Minor Ingredients (wt. %) | 0.7 CMC | 0.7 CMC | 0.7 CMC | 0.7 CMC | 0.7 CMC |
| | 0.6 bright. | 0.6 bright. | 0.6 bright. | 0.6 bright. | 0.6 bright. |
| | [0.9 PEG] | [0.9 PEG] | [0.9 PEG] | [0.9 PEG] | [0.9 PEG] |
| Moisture (wt. %; dried C.M. basis) | 4.0 | 0.5 | ~5 | ~5 | ~5 |

Footnotes to Table IV are given on Table X.

Table V

| Clay Removal Performance ($\Delta W_n$) | | | | |
|---|---|---|---|---|
| 2:1 $Ca^{++}/Mg^{++}$ Hardness (gr./gal.) | Cotton Fabric | | Dacron Fabric | |
| Composition | 6.0 | 8.0 | 6.0 | 8.0 |
| Example 4: 23% pyrophosphate, acidified silicate, 5% moisture | 10.2 | 11.8 | 16.4 | 15.5 |
| Example 3: 23% pyrophosphate, acidified silicate, 0.5% moisture | 10.5 | — | 18.3 | — |
| RC-5: 23% pyrophosphate, no silicate pretreatment | 10.0 | 8.1 | 11.8 | 11.6 |
| RC-4: 35% triphosphate, no polyethylene glycol | 12.1 | 10.4 | 18.0 | 16.6 |

These test results show, for the compositions of this invention, an advantage for a 0.5% moisture composition in comparison with a 5.0% moisture composition that is otherwise similar. Both compositions of the invention are superior to the comparable composition made without acidification, and approach the performance of the commercial product.

EXAMPLE 5

A detergent composition was prepared in a manner similar to that of Example 2, except that 30 grams of fatty acid and 75 grams of pyrophosphate were added to 7855 grams of silicate solution. [The types of fatty acid, pyrophosphate, and silicate were the same as those of Example 2.] The cleaning performance of this composition is substantially like that of the composition of Example 2.

Compositions of Examples 4 and 5 are given in in detail on Table IV.

EXAMPLE 6

A detergent composition was prepared in a manner similar to that of Example 2 except 16 grams of unhardened tallow fatty acid and 60 grams of pyrophosphate were added to 6538 grams of liquid silicate having a molar $Na_2O/SiO_2$ ratio of 0.417 and a solids content of 47%. The cleaning performance of this composition is similar to that of the composition of Example 2.

EXAMPLE 7

A detergent composition was prepared in a manner similar to that of Example 6 except that 40 grams of fatty acid and 680 grams of pyrophosphate were added to the 0.417 ratio silicate solution. Its performance is substantially the same as that of Example 6.

Compositions of Examples 6 and 7 are given on Table VI.

EXAMPLE 8

A silicate premix was prepared by adding 5.2 grams of 3.7% hydrochloric acid to 100 grams of liquid silicate having a molar ratio of $Na_2O$ to $SiO_2$ of 0.31.

The silicate was heated to about 170° F. and the acid was added during a one-minute period, using a propeller to provide agitation. After all the acid was added, the silicate premix was subjected to an agitation period of 15 minutes.

The premix was then added to a previously prepared partial crutcher mix containing sodium alkyl benzene sulfonate, sodium toluene sulfonate, sodium sulfate, optical brightener and carboxymethyl cellulose; tetrasodium pyrophosphate was added last.

Table VI

| EXAMPLE NO. | 6 | 7 | 8 | R6 | 9 |
|---|---|---|---|---|---|
| COMPOSITION, etc. | | | | | |
| Silicate Premix | 0.42 | 0.42 | 0.31 | 0.50 | 0.31 |
| $\rho$=mols $Na_2O$/mols $SiO_2$ | | | | | |
| Silicate Solids (wt. %) | 10.0 | 10.0 | 10.0 | 6.0 | 10.0 |
| $SiO_2$ (wt.%) | 7.0 | 7.0 | 7.6 | 4.0 | 7.6 |
| Acid Type | fatty* | fatty* | HCl | none | HCl |
| Eq. Acid/Mols $SiO_2$ | 0.00076 | 0.0019 | 0.0111 | — | 0.024 |
| Agitation Period (min.) | 5–10 | 5–10 | 5 | — | 5 |
| Crutcher Mix | | | | | |
| Surfactant (wt.%) | 18 LAS<br>3 soap | 18 LAS<br>3 soap | 26.2 ABS | 26.2 ABS | 26.2 ABS |
| Structurant (wt.%) | 23 pyro<br>bal. $Na_2SO_4$ | 23 pyro<br>bal. $Na_2SO_4$ | 16.2 pyro<br>bal. $Na_2SO_4$ | 32.5 STP<br>bal. $Na_2SO_4$ | 16.2 pyro<br>bal. $Na_2SO_4$ |
| Na Toluene Sulfonate (wt. %) | 0.9 | 0.9 | 2.6 | 2.6 | 2.6 |
| Water (wt.%, slurry basis) | ~50 | ~50 | ~35 | ~35 | ~35 |
| Admixed Adjuvant (wt. %) | none | none | none | none | none |
| Minor Ingredients (wt. %) | 0.7 CMC<br>0.6 bright.<br>[0.9 PEG] | 0.7 CMC<br>0.6 bright.<br>[0.9 PEG] | 0.7 CMC<br>0.2 bright. | 0.7 CMC<br>0.2 bright.<br>perf. | 0.7 CMC<br>0.2 bright. |
| Moisture (wt. %; dried C.M. basis) | ~5 | ~5 | 7 | 14 | 13 |

Footnotes to Table VI are given on Table X.

The crutcher mix was spray-dried in a pilot scale tower to form granules having a moisture content of 7%. The composition of the final detergent composition is given in detail in Table VI.

The composition of Example 8 was tested for clay soil removal in a side-by-side comparison with a commercial product not within the scope of this invention designated as R6 and having the formula given in detail on Table VI.

Illite subsoil clay was applied by padding, following by oven drying, to fabrics made of cotton and 40/60 cotton/polyester. Swatches cut from the soiled fabric were read, before and after washing, by a Gardner XL-10 Color Difference Meter with the ultraviolet screened out. Differences in whiteness were determined by the Hunter equation $$\Delta W_H = \frac{7L^2 - 40\ Lb}{700}$$

The soiled swatches were washed in a Tergitometer operating at 80 cycles per minute for 10 minutes at a temperature of 85° F., using a water-to-cloth ratio of 30:1 and a usage of 0.5% detergent composition by weight. Hardness was controlled by a synthetic solution having a 3:1 ratio of $Ca^{++}$:$Mg^{++}$. Following washing the swatches were rinsed, using medium hardness tap water, and were dried before making the final Gardner measurement.

Clay soil removal data for the composition of Example 8, relative to the commercial standard R6, are given on Table VII.

Table VII

| Relative Clay Removal Performance $\Delta(\Delta W_H)$ Example 8 (16.2% pyrophosphate, treated silicate) compared with Commercial Product R6 (32.5% triphosphate) | | |
|---|---|---|
| Hardness (grains/gal.) | Fabric: cotton | Fabric: cotton/polyester |
| 22 | −1 | −5 |
| 25 | +3 | −4 |
| 27 | +1 | −3 |
| 30 | +1 | −1 |

Four $\Delta(\Delta W_H)$ units are a significant difference at 90% confidence. The composition of the invention was only slightly inferior, and only under certain test conditions, to the reference composition which contains twice as much phosphate. The composition of the invention performed relatively better in comparison with the reference composition as water hardness increased beyond the 22 gr./gal. point, which is where the composition supplies builder in 1:1 ratio to the hardness present for the washing concentration used in the test. This is suprizing and unexpected, as ordinarily detergent compositions show a rapid decline in capacity to remove clay soil when the builder/hardness ratio drops below 1:1, i.e. when they are "underbuilt". [The reference composition, containing more phosphate, was not underbuilt for any of the water hardnesses of this test.]

EXAMPLE 9

A composition was prepared like that of Example 8 except that 0.024 equivalents of HCl were used to acidify the silicate instead of the 0.0111 equivalents used for Example 8 [see Table VI] and it was dried to 13 instead of 7% moisture. Lumps formed in the silicate premix to a greater extent than for the composition of Example 8, but they diminished somewhat upon agitation [5 minutes] and did not seriously interfere with spray-drying, even on the pilot scale tower. In tests similar to those to which the composition of Example 8 was subjected, cleaning performance was similarly good. Examples 10 through 18 are within the scope of the present invention and are prepared in the manner of Example 1 except for the variations described on Tables VIII and IX. These detergent compositions have good cleaning performance substantially like that of Example 1.

EXAMPLE 19

A detergent composition is prepared in a manner like that of Example 2 except that 1.0 wt. % of the tetrasodium pyrophosphate on a finished detergent composition basis is replaced by a like amount of Glass H, a glassy phosphate commercially available from the FMC Corporation which is a sodium salt containing 21 phosphorus atoms per molecule. The cleaning performance of this composition is good and its whiteness maintenance performance is excellent.

Table VIII

| EXAMPLE NO. | 10 | 11 | 12 | 13 | 14 |
|---|---|---|---|---|---|
| COMPOSITION, etc. | | | | | |
| Silicate Premix | | | | | |
| $\rho$=mols $Na_2O$/mols $SiO_2$ | 0.43 | 0.33 | 0.26 | 0.50 | 0.27 |
| Silicate Solids (wt. %) | 18.8 | 13.4 | 10.2 | 15.2 | 20.5 |
| $SiO_2$ (wt.%) | 13.0 | 10.0 | 8.0 | 10.0 | 16.0 |
| Acid Type | AB sulfonic | HCl | fatty | acid pyro | fatty |
| Eq. Acid/Mols $SiO_2$ | 0.006 | 0.15 | 0.03 | 0.01 | 0.0006 |
| Agitation period (min.) | 5 | 30 | 10 | 4 | 2 |
| Crutcher Mix | | | | | |
| Surfactant (wt.%) | 25 LAS | 4 ABS | 13 AS | 50 ABS | 20 LAS |
| Structurant (wt.%) | 5 pyro<br>4 $Na_2SO_4$ | 58 pyro<br>bal. $CaCO_3$ | 2 $Na_2SO_4$<br>2 nat. clay | 5 pyro<br>2 syn. clay | bal. pyro. |
| Na Toluene Sulfonate (wt. %) | 1 | 2 | 0 | 1 | 3 |
| Water (wt.%, slurry basis) | 40 | 55 | 35 | | |
| Admixed Adjuvant (wt. %) | bal. pyro, | none | bal. pyro | bal. $Na_2CO_3$<br>5 pyro | none |
| Minor Ingredients (wt. %) | | | | | |
| Moisture (wt. %; dried C.M. basis) | 12 | 5 | 15 | 0.5 | 1 |

Footnotes to Table VIII are given on Table X.

Table IX

| EXAMPLE NO. | 15 | 16 | 17 | 18 |
|---|---|---|---|---|
| COMPOSITION, etc. | | | | |
| Silicate Premix | | | | |
| $\rho$=mols $Na_2O$/mols $SiO_2$ | 0.30 | 0.31 | 0.28 | 0.25 |
| Silicate Solids (wt. %) | 3.9 | 2.6 | 2.1 | 6.3 |
| $SiO_2$ (wt.%) | 3.0 | 2.0 | 1.6 | 5.0 |
| Acid Type | HCl | acid pyro | $H_2SO_4$ | AB sulfonic |
| Eq. Acid/Mols $SiO_2$ | 0.003 | 0.0008 | 0.4 | 0.0012 |
| Agitation Period (min.) | 15 | 25 | 1 | 10 |
| Crutcher Mix | | | | |
| Surfactant (wt.%) | 4 LAS<br>4 AES | 35 ABS | 40 LAS | 18 LAS |
| Structurant (wt.%) | 30 pyro | 30 pyro | 7 pyro | bal. $Na_2CO_3$ |

Table IX-continued

| EXAMPLE NO. | 15 | 16 | 17 | 18 |
|---|---|---|---|---|
| | 9 STP | | 10 amor. alsil. | |
| Na Toluene Sulfonate (wt. %) | 0 | 4 | 2 | 2 |
| Water (wt.%, slurry basis) | | | | |
| Admixed Adjuvant (wt. %) | bal. $CaCO_3$ 8 perborate | 5 pyro bal. syn. alsil. | 20 amor. alsil. bal. $Na_2SO_4$ | 6 pyro |
| Minor Ingredients (wt. %) | | | | |
| Moisture (wt. %; dried C.M. basis) | 10 | 2 | 1 | 3 |

Footnotes to Table IX are given on Table X.

Table X

Footnote to Tables I, IV, VI, VIII and IX
Defining the Abbreviations used in the Tables.

Unless otherwise specified, the wt.% of all components is given on a finished detergent composition basis.

| | |
|---|---|
| R | A reference composition, not within the scope of the present invention. |
| fatty | Unhardened tallow fatty acid. |
| AB sulfonic | The acid form of the ABS defined above. |
| * | $Na_4P_2O_7$ was also added to the silicate premix. |
| ABS | Alkyl benzene sulfonate having a branched alkyl chain averaging ~12 carbon atoms in length. |
| LAS | Alkyl benzene sulfonate having a straight alkyl chain averaging 11.8 carbon atoms in length. |
| AS | Alkyl sulfate having a straight alkyl chain derived from tallow. |
| AES | Alkyl ether sulfate, the sulfated condensation product of an alcohol having a straight alkyl chain averaging 14 carbon atoms in length with ethylene oxide in the proportion of 3 mols per mol of alcohol. |
| soap | Unhardened tallow soda soap. |
| pyro | Sodium pyrophosphate $Na_4P_2O_7$. |
| acid pyro | Sodium acid pyrophosphate $Na_2H_2P_2O_7$. |
| STP | Sodium triphosphate $Na_5P_3O_{10}$. |
| amor.alsil. | Amorphous aluminosilicate $Na_x(xAlO_2 . ySiO_2)$. |
| syn. alsil. | Synthetic aluminosilicate $Na_x[AlO_2)_x . (SiO_2)_y]xH_2O$. |
| perborate | Sodium perborate. |
| bright. | Optical brightener. |
| CMC | Carboxymethyl cellulose. |
| perf. | Perfume |
| [PEG] | Polyethylene glycol having a molecular weight of 6000. For experimental reasons, this was not admixed to dried detergent granules in the customary manner, but was added along with PEG-free compositions to performance evaluation solutions. |
| Moisture | Wt.% on dried Crutcher Mix basis. |

What is claimed is:

1. A process for preparing a detergent composition comprising:

a. acidifying an aqueous alkali metal silicate with acid, during agitation, thereby forming a silicate premix;

wherein the alkali metal silicate has the formula $\rho M_2O.SiO_2$, where M is alkali metal and $\rho$, the ratio of (mols $M_2O$) to (mols $SiO_2$), is from about 0.25 to about 0.50; and wherein the amount of acid, expressed as a ratio of (equivalents of acid) to (mols $SiO_2$ in the silicate), is between about 0.0005 and about 0.4;

b. mixing said silicate premix with an aqueous slurry comprised of surfactant, water, and at least one structurant, i.e. structure-forming compound, thereby forming a crutcher mix;

wherein the surfactant is anionic, nonionic, semipolar, zwitterionic, ampholytic, or mixtures thereof; and wherein the structurant is selected from the group consisting of calcium carbonate; natural and synthetic clays; nitrilotriacetates; aluminosilicates; and alkali metal pyrophosphates, triphosphates, glassy phosphates, carbonates, bicarbonates, sesquicarbonates, chlorides, borates, perborates, sulfates, bisulfates, aluminates, and mixtures thereof;

c. drying said crutcher mix to a moisture of from about 0.5% to about 15% by weight of the dried crutcher mix; and d. adding admixed adjuvant to said dried crutcher mix, thereby forming said detergent composition;

wherein the admixed adjuvant is selected from the group consisting of calcium carbonate; sodium aluminosilicates; alkali metal pyrophosphates, carbonates, borates, bicarbonates and sulfates; water-soluble aminopolycarboxylates; water-soluble salts of phytic acid; water-soluble polyphosphonates; and water-soluble salts of mellitic acid, citric acid, pyromellitic acid, benzene pentacarboxylic acid, oxydiacetic acid, carboxymethyloxysuccinic acid, and oxydisuccinic acid;

wherein percentages of the components by weight, expressed in relation to the final detergent composition, are: $SiO_2$ in the silicate from about 1.5% to about 16%; surfactant from about 4% to about 50%; structurant from about 4% to about 90%; and admixed adjuvant from 0 to about 80%;

and wherein alkali metal pyrophosphate, $M_xH_yP_2O_7$, where M is alkali metal and x and y are integers having the sum of 4, is present in the composition in an amount from about 5% to about 60%, said pyrophosphate being present as either structurant or admixed adjuvant or both.

2. The process of claim 1 wherein the silicate premix is subjected to an agitation period of from about 1 minute to about 120 minutes after acid addition is complete, prior to mixing with the aqueous slurry.

3. The process of claim 2 wherein the crutcher mix is dried to a moisture from about 1% to about 10% by weight of the dried crutcher mix.

4. The process of claim 2 wherein the drying process is spray-drying.

5. The process of claim 4 wherein the spray-drying is carried out in a multilevel tower process.

6. The process of claim 2 wherein the crutcher mix is dried to a moisture from 2% to 5% by weight of the dried crutcher mix by the process of spray-drying.

7. The process of claim 1 wherein the surfactant is selected from the group consisting of alkali metal and ammonium salts of fatty acid, alkyl benzene sulfonate, alkyl sulfate, alkyl ether sulfate, and mixtures thereof.

8. The process of claim 1 wherein the alkali metal silicate is sodium silicate and the alkali metal pyrophosphate is sodium pyrophosphate.

9. The process of claim 1 wherein the acid is a surfactant-acid, acid pyrophosphate, or a mineral acid.

10. The process of claim 2 wherein the crutcher mix is dried to a moisture from about 1% to about 10% by weight of the dried crutcher mix; and wherein percentages of the components by weight, expressed in relation to the final detergent composition, are: $SiO_2$ in the silicate from about 2% to about 13%; surfactant from about 8% to about 40%; structurant from about 40 to about 85%; pyrophosphate from about 10% to about 50%; and admixed adjuvant from 0 to about 50%.

11. The process of claim 2 wherein $\rho$, the ratio of (mols $M_2O$) to (mols $SiO_2$), is between about 0.26 and about 0.42; and wherein the ratio of (equivalents of acid) to (mols $SiO_2$) in the silicate is between about 0.001 and about 0.1.

12. The process of claim 10 wherein the surfactant is selected from the group consisting of sodium salts of fatty acid, alkyl benzene sulfonate, alkyl sulfate, alkyl ether sulfate, and mixtures thereof;

wherein the alkali metal silicate is sodium silicate and the alkali metal pyrophosphate is sodium pyrophosphate;

wherein $\rho$, the ratio of (mols $Na_2O$) to (mols $SiO_2$), is between 0.27 and 0.33, the ratio of (equivalents if acid) to (mols $SiO_2$) in the silicate is between 0.002 and 0.02, and the agitation period of the silicate premix is from 5 to 30 minutes;

wherein the crutcher mix is dried to a moisture from 2% to 5% by weight of the dried crutcher mix by the process of spray-drying; and wherein percentages of the components by weight, expressed in relation to the final detergent composition, are $SiO_2$ in the silicate from 2.5% to 10%; surfactant from 12% to 30%; structurant from 60% to 80%; pyrophosphate from 15% to 40%; and admixed adjuvant from 0 to 20%.

13. The process of claim 1 containing as structurant or admixed adjuvant from about 1% to about 40% on a detergent composition basis of an amorphous water-insoluble hydrated compound of the formula $Na_x(xAlO_2.ySiO_2)$, wherein $x$ is a number from 1 to 1.2 and $y$ is 1, said amorphous compound being further characterized by a $Mg^{++}$ exchange capacity of from about 50 milligrams equivalent of $CaCO_3$ hardness/gram to about 150 milligrams equivalent of $CaCO_3$ hardness/gram on an anhydrous basis.

14. The process of claim 1 containing as structurant or admixed adjuvant from about 1% to about 40% on a detergent composition basis of a water-insoluble crystalline synthetic aluminosilicate ion exchange material of the formula $Na_zxH_2O$, wherein $z$ and $y$ are integers of at least 6; the molar ratio of $z$ to $y$ is in the range from 1.0 to about 0.5, and $x$ is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness/gram; and a calcium ion exchange rate on an anhydrous basis of at least about 2 grains/gallon/minute/gram.

15. The process of claim 1 additionally containing from about 0.1% to about 4% by weight of a glassy phosphate of the formula $$(M_2O)_x\,(P_2O_5)_y$$

wherein $y$ is from about 5 to about 50 and the ratio of $y$:$x$ is from about 1:1 to about 1:15 and M is an alkali metal.

16. The process of claim 12 additionally containing from about 0.1% to about 4% by weight of a glassy phosphate of the formula $$(M_2O)_x\,(P_2O_5)_y$$

wherein $y$ is from about 5 to about 50 and the ratio of $y$:$x$ is from about 1:1 to about 1:15 and M is an alkali metal.

17. The process of claim 16 wherein the glassy phosphate has 14 or 21 phosphorus atoms.

18. The process of claim 13 additionally containing from about 0.1% to about 4% by weight of a glassy phosphate of the formula $$(M_2O)_x\,(P_2O_5)_y$$

wherein $y$ is from about 5 to about 50 and the ratio of $y$:$x$ is from about 1:1 to about 1:15 and M is an alkali metal.

19. The process of claim 14 additionally containing from about 0.1% to about 4% by weight of a glassy phosphate of the formula $$(M_2O)_x\,(P_2O_5)_y$$

wherein $y$ is from about 5 to about 50 and the ratio of $y$:$x$ is from about 1:1 to about 1:15 and M is an alkali metal.

* * * * *

UNITED STATES PATENT OFFICE

CERTIFICATE OF CORRECTION

PATENT NO. : 4,007,124

DATED : Feb. 8, 1977

INVENTOR(S) : Everett Joshua Collier and John Edward Morrow

It is certified that error appears in the above-identified patent and that said Letters Patent are hereby corrected as shown below:

In claim 14 at column 26 line 1, the formula reading $$Na_z xH_2O$$

should read $$Na_z[(AlO_2)_z \cdot (SiO_2)_y]xH_2O$$

Signed and Sealed this

Twenty-first Day of June 1977

[SEAL]

*Attest:*

RUTH C. MASON
*Attesting Officer*

C. MARSHALL DANN
*Commissioner of Patents and Trademarks*